United States Patent [19]

Newcomb

[11] 4,387,744

[45] Jun. 14, 1983

[54] THREAD SEVERING MECHANISM ASSOCIATED WITH SHUTTLELESS LOOM

[75] Inventor: Kermit T. Newcomb, South Hill, Va.

[73] Assignee: Burlington Industries, Inc., Greensboro, N.C.

[21] Appl. No.: 249,867

[22] Filed: Apr. 1, 1981

[51] Int. Cl.[3] ..... D03D 47/36

[52] U.S. Cl. ..... 139/429; 139/302

[58] Field of Search ..... 139/429, 302, 303, 263–268; 83/658

[56] References Cited

U.S. PATENT DOCUMENTS

| | | | |
|---|---|---|---|
| 1,230,792 | 6/1917 | Sabbag . | |
| 1,770,366 | 7/1930 | Burdett | 139/303 |
| 1,881,922 | 10/1932 | Payne . | |
| 1,881,923 | 10/1932 | Payne . | |
| 1,882,920 | 10/1932 | Payne . | |
| 2,007,485 | 7/1935 | Toyoda . | |
| 2,287,666 | 6/1942 | Brown . | |
| 2,319,181 | 5/1943 | Nichols . | |
| 2,341,839 | 2/1944 | Belforti . | |
| 3,292,477 | 12/1966 | Raftery | 83/658 |
| 3,347,282 | 10/1967 | Kokkinis . | |
| 3,532,020 | 10/1970 | Sandborn et al. | 83/658 |
| 3,837,252 | 9/1974 | Brassel | 83/658 |
| 3,903,932 | 9/1975 | Camprubi | 139/303 |
| 3,951,179 | 2/1976 | Pfarrwaller . | |

FOREIGN PATENT DOCUMENTS

| | | | |
|---|---|---|---|
| 680519 | 1/1965 | Italy | 139/302 |

*Primary Examiner*—Henry Jaudon

*Attorney, Agent, or Firm*—Cushman, Darby & Cushman

[57] ABSTRACT

A thread severing mechanism is provided that has a long life and is easily and inexpensively replaceable, even when cutting glass yarn. The thread severing device includes a cutting blade having a razor edge, and an anvil with the thread supporting surface defined by a rubber block. The blade is moved with respect rubber block so that the razor edge comes in contact with the block, severing any thread between them. The anvil is desirably mounted on a temple of a shuttleless loom, its position with respect to the cutting blade is adjustable, and it includes an outwardly extending fabric guide that prevents the loom fabric from riding up onto the rubber block.

13 Claims, 3 Drawing Figures

THREAD SEVERING MECHANISM ASSOCIATED WITH SHUTTLELESS LOOM

BACKGROUND AND SUMMARY OF THE INVENTION

In many textile machines, it is necessary to have some sort of a thread or yarn severing device. This is particularly so in the case of shuttleless looms, such as air and water jet looms like the Elitex air jet loom. For cutting certain types of threads a mechanical device is essential, and such mechanical cutting devices usually comprise scissors elements, or chisel and anvil cutting components. For instance for Elitex air jet looms designed for weaving glass yarn, a cutting mechanism is provided comprising two blades that operate in a scissors motion to cut the yarn as it completes an insertion cycle on the loom. While such cutters are operational, they are relatively expensive to maintain, requiring frequent resharpening, and being expensive to replace, the entire cutting mechanism being replaceable.

There have been proposals in the art recognizing advantages in avoidance of wear associated with chisel and anvil cutting mechanisms, as described in U.S. Pat. Nos. 3,951,179 and 2,007,485. However, either the chisel-like elements associated with such prior proposals have not been readily replaceable, or are not designed for utilization with some types of shuttleless looms, or they are not easily retrofit onto or finely adjusted on such looms.

According to the present invention, a thread severing mechanism in general, and in particular a shuttleless loom utilizing a thread severing mechanism, are provided having numerous advantages. Utilizing the thread severing mechanism according to the present invention on a conventional shuttleless loom, such as an Elitex air jet loom, costs associated with maintaining the severing mechanism are reduced by several orders of magnitude. Further, the thread severing mechanism according to the present invention is conveniently positioned on a conventional loom on pre-existing loom structures with a minimum of modification, yet effectively and efficiently performs its intended operation. When maintenance is necessary, however, component parts of the severing mechanism may be readily replaced.

According to one aspect of the present invention, a thread severing mechanism is provided which comprises the following elements: A cutting blade having a razor edge. An anvil having a thread supporting surface, the thread supporting surface including a block of material having the blade-protection and thread-severing-facilitating properties of rubber. And, means for effecting movement of the blade with respect to the anvil thread supporting surface so that the blade razor comes in contact with the thread supporting surface, severing any thread supported thereon. Additionally, means are provided for readily detachably mounting the blade to the means for effecting movement thereof so that the blade may be readily replaced when the razor edge thereof does wear out. This detachable means may comprise a threaded end of a shaft and a pair of internally threaded nuts, one disposed on either side of the blade, abutting the blade, and in screw-threaded engagement with the shaft. The shaft may comprise a component part of the means for moving the blade, which means further includes a bushing for mounting the shaft for rotation about an axis generally perpendicular to the blade, and an actuator operatively associated with the shaft at a portion thereof remote from the blade, for effecting rotation of the shaft about its axis.

The anvil is mounted so that its position with respect to the cutting blade may be varied, and such mounting means may comprise an elongated slot formed in a portion of the anvil and a threaded fastener extending through the slot. The fastener is positioned and dimensioned so that when it is tightened down to a supporting surface the anvil is held in place with respect to the supporting surface, and when it is not tightened down the anvil is movable with respect to the supporting surface with the fastener sliding within the elongated slot. The anvil thread supporting surface is mounted on a portion of the anvil generally perpendicular to the anvil portion having the elongated slot, and a fabric guide extends outwardly from that portion of the anvil.

According to another aspect of the present invention, a shuttleless loom is provided with an improved thread severing mechanism. The loom includes means for inserting thread in an insertion cycle into the loom, and has a portion thereof, which includes a temple, adjacent the area of insertion of the thread. The thread severing mechanism comprises an anvil having a thread supporting surface, a cutting blade having a razor edge, means for mounting the anvil on the temple, and means for effecting movement of the blade with respect to the anvil thread supporting surface so that the razor edge comes in contact with the thread supporting surface, severing any thread supported thereon. The anvil mounting means previously described mounts the anvil on the temple, the threaded fastener being received by a threaded opening formed in the temple. A fabric guide means may comprise a rod extending outwardly from the anvil generally parallel to the temple, and prevents the fabric from riding up on the thread supporting surface of the anvil. The blade movement effecting means preferably is as previously described, and may be readily retrofit into many existing loom yarn severing actuator structures.

It is the primary object of the present invention to provide an efficient and inexpensive thread severing mechanism, particularly for a shuttleless loom. This and other objects of the present invention will become clear from an inspection of the detailed description of the invention, and from the appended claims.

DETAILED DESCRIPTION OF THE DRAWINGS

Figure 1:
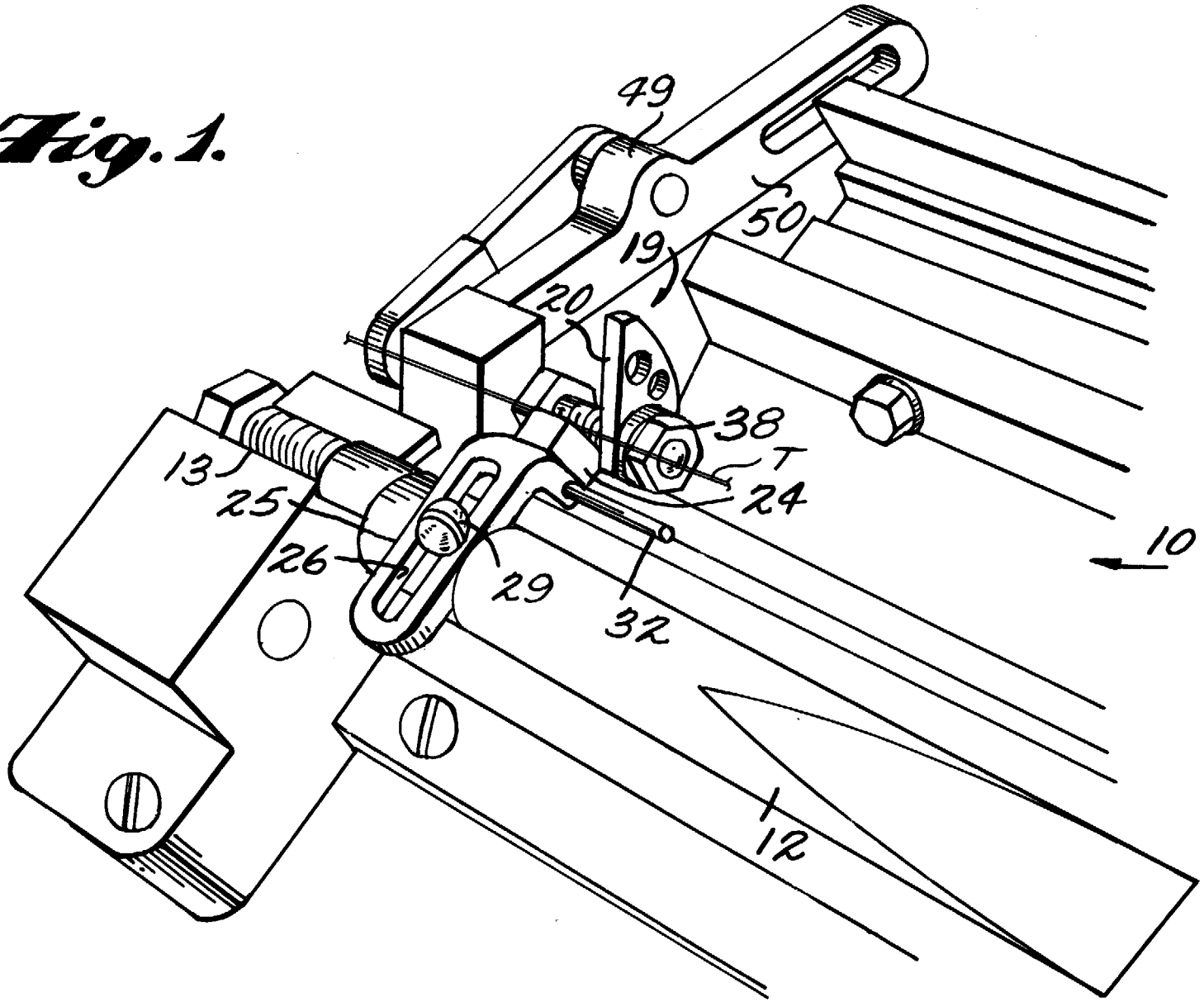
FIG. 1 is a partial perspective view of a weft thread insertion portion of a conventional air jet loom, showing the positioning of a thread severing mechanism according to the present invention therein.
Figure 2:
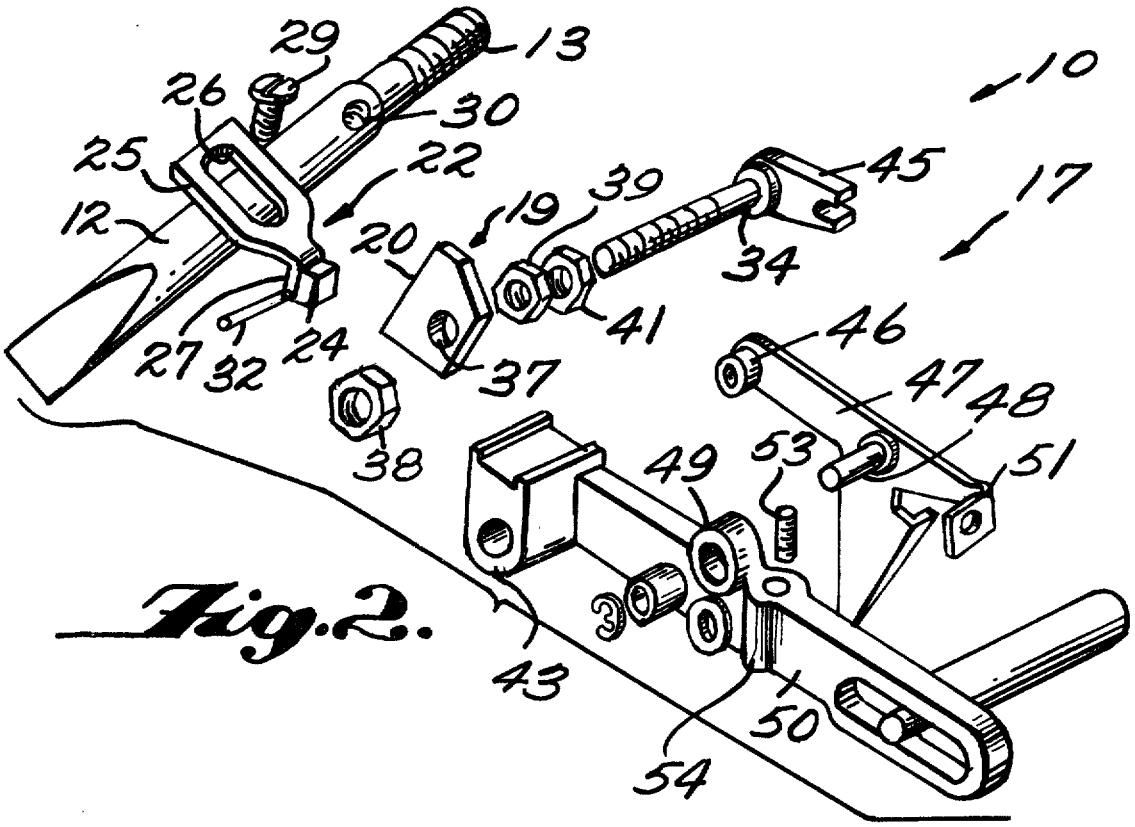
FIG. 2 is a perspective detail view of the components of the thread severing mechanism according to the present invention, detached from the loom.

A portion of a conventional air jet loom, in particular an Elitex air jet loom, is shown generally at 10 in FIG. 1. The loom includes means for inserting thread in an insertion cycle into the loom, such means being shown schematically at 11. In the particular embodiment illustrated in the drawings, the inserting mechanism 11 would be an air jet and a supply of yarn fed to the air jet, although depending upon loom type the insertion mechanism would vary widely. The portion of the loom 10 adjacent the area of insertion is illustrated in FIG. 1, this portion including a temple 12, which is a conventional loom structure for holding down the fabric produced by the loom. The temple 12 includes a threaded end 13 thereof, and is held in place by a threaded nut 14 attached to the loom, and a loom collar 15. An advantageous thread severing mechanism according to the present invention is associated with the loom 10, and is shown generally at 17 in FIGS. 1 through 3.

The thread severing mechanism 17 includes a cutting blade 19 having a razor edge 20. Further, the means 17 includes an anvil 22 having a thread supporting surface 24. Preferably the thread supporting surface is a block of material having the blade-protection and thread-severing-facilitating properties of rubber. For instance rubber itself can be used, the durometer of the rubber depending upon the type of thread to be cut. For instance where glass yarn is to be cut, the rubber comprising the block 24 would be relatively soft.

The anvil 22 preferably includes a first portion 25 having an elongated slot 26 formed therein, the slot 26 extending in a dimension generally parallel to, or in-line with, the razor edge 20, and generally perpendicular to the temple 12. The preferred anvil 22 also preferably comprises a second portion 27 thereof which is generally perpendicular to the first portion 25, and to which the thread supporting surface 24 is cemented or otherwise attached.

The anvil 22 is mounted to the temple 12 so that no accessory structures need be added to the loom 10 in order to accommodate the advantageous thread severing device according to the present invention. The means for mounting the anvil 22 to the temple 12 allows adjustment of the position of the block 24 with respect to the cutting edge 20 so that a precise cut may be obtained. This is preferably accomplished by providing a threaded fastener 29 adapted to be received by the elongated slot 26, and to be received by the threaded opening 30 in the temple 12. When the fastener 29 is tightened down, received by opening 30, the anvil is retained in the position to which it has been moved with respect to the temple 12; however, when the fastener 29 is not tightened down the anvil 22 is movable with respect to the temple 12, the anvil 22 slot 26 sliding with respect to the fastener 29.

The anvil 22 further comprises a fabric guide means for preventing the loom fabric from riding up on the thread supporting surface 24. The fabric guide means may simply comprise a rod 32 extending outwardly from the anvil second portion 27 generally parallel to the temple 12. The rod 32 is shown in FIG. 3 as a conventional circular cross-section rod welded to the anvil 22, although it may take a wide variety of forms and shapes.

Means are provided for effecting movement of the blade 19 with respect to the anvil thread supporting surface 24 so that the blade razor edge 20 comes in contact with the surface 24, severing any thread supported thereon. The means for effecting movement of the blade preferably comprises a shaft 34 (see FIG. 3 in particular) having a threaded end 35 thereof. Means are provided for readily detachably mounting the blade 19 to the shaft 34, including the bore 37 in blade 19 and nuts 38 and 39. The shaft 34 extends through opening 37, its axis of rotation perpendicular to the blade 19, and the nuts 38, 39 are tightened into abutting engagement with the blade on either side thereof, holding the blade 19 in place. Suitable lock washers (not shown) are preferably associated with the nuts 38, 39.

The shaft 34 passes through a bushing 43 which mounts it for rotation about its axis, and a nut 41 may be provided which threadably engages end 35 of the shaft 34 to provide a stop to prevent movement of the shaft 34 out of the bushing 43. An actuator structure 45 is mounted on the end of the shaft 34 opposite the threaded end 35, and opposite the bushing 43 as the blade 19. The actuator 45 is actuated by a suitable mechanism on the loom.

Figure 3:
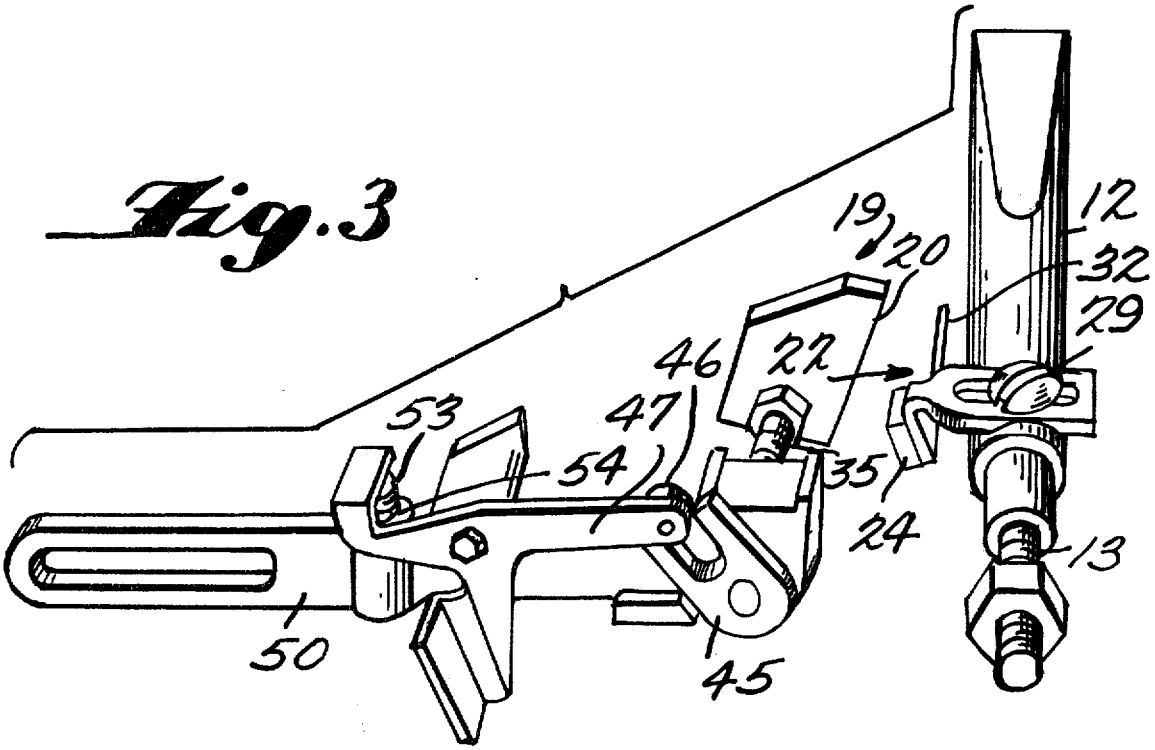
FIG. 3 is an exploded perspective view of the mechanism of FIG. 2.

A suitable conventional mechanism for actuating the actuator 45 is most clearly illustrated in FIG. 3. This mechanism includes an actuating portion 46 of a lever 47 which is pivotal about pivot pin 48 received by bushing 49 in support member 50. The support member 50 also contains the bushing 43. End 51 of lever 47 engages a coil spring 53 received within a opening 54 formed in the member 50. A cam, or other suitable structure, acts on the lever end 51 to depress it against spring pressure, causing the element 46 to act on the actuator 45 to rotate the shaft 34 in bushing 43, and thus rotate the blade edge 20 into contact with the block 24. The structures 47, 50, etc., are those conventionally provided on an Elitex air jet loom, thus the thread severing mechanism according to the present invention may be readily retrofit onto such a loom. With minor adaptation, retrofitting onto a wide variety of other conventional shuttleless looms is also possible.

The thread severing mechanism according to the present invention is utilizable in a wide variety of textile machines, but particularly on shuttleless looms of any type, although perhaps most practical with air jet and water jet looms. The mechanism is also capable of severing any types of threads conventionally used in weaving, but has particular advantages when used for severing glass threads which cause other mechanical cutting mechanisms to quickly wear out, and which are incapable of being severed utilizing heated yarn-severing elements.

Exemplary apparatus according to the present invention having been described, an exemplary manner of operation thereof will now be set forth.

On an existing Elitex air jet loom, a threaded opening 30 is formed in the loom temple 12, an anvil 22 is mounted in place by passing fastener 29 through elongated slot 26, adjusting the position of the slot 26 with respect to the fastener 29, and tightening the fastener in opening 30. The conventional scissors thread severing mechanism is removed, shaft 34 having threaded end 35 is passed through bushing 43 with the structure 45 thereof in engagement with actuator 46, nut 41 is threaded on the shaft 35 to hold it in place with respect to bushing 43, and the blade 19 is moved to the desired position and held in place on the threaded end 35 of shaft 34, using nuts 38, 39.

Once the thread insertion means inserts a weft thread T (see FIG. 1) into the loom 11, the loom automatically pushes down on the lever end 51, the actuator 46 then acting upon actuator structure 45 to rotate shaft 34 in bushing 43. This effects rotation of blade 19 razor edge 20 into contact with the rubber block 24. The anvil 22 is positioned so that the thread T during insertion is supported by block 24, and thus the thread T is severed by the blade 19 movement. Because of the nature of the block 24, it protects the razor edge 20 while still allowing ready severing of the thread supported thereon.

This action is repeated after completion of each insertion cycle.

After some time, the edge 20 of the blade 19 will wear out. It is a simple matter to replace the blade 19, merely by unscrewing nut 38 (and removing any associated lock washer), sliding the blade 19 off of the shaft 34, putting a new blade 19 on, and tightening the nut 38. Thus, only a minor inexpensive component part need be replaced periodically. Eventually, if the anvil block 24 wears out, the entire anvil may also be readily replaced merely by removing fastener 29, or the block 24 may be mounted to the anvil portion 27 in a manner that allows detachment thereof.

It will thus be seen that according to the present invention an advantageous thread severing mechanism, particularly for use with a shuttleless loom, has been provided.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A thread severing mechanism comprising:

a cutting blade having a razor edge;

an anvil having a thread supporting surface, said thread supporting surface including a block of material having the blade-protection and thread-severing-facilitating properties of rubber;

means for effecting movement of said blade with respect to said anvil thread supporting surface so that said blade razor edge comes in contact with said thread supporting surface, severing any thread supported thereon;

means for mounting said anvil so that its position with respect to said cutting blade may be varied, said mounting means comprising an elongated slot formed in a portion of said anvil, and a threaded fastener extending through said slot and positioned and dimensioned so that when it is tightened down to a supporting surface the anvil is held in place with respect to the supporting surface, and when it is not tightened down the anvil is movable with respect to the supporting surface, with the fastener sliding within said elongated slot; and wherein said anvil block thread supporting surface is mounted on a portion of said anvil generally perpendicular to said anvil portion having said elongated slot.

2. A device as recited in claim 1 further comprising means for readily detachably mounting said blade to said means for effecting movement thereof so that said blade may be readily replaced.

3. A device as recited in claim 2 wherein said means for effecting movement of said blade comprises: a shaft operatively attached to said blade and having an axis extending perpendicularly to and through said blade; a bushing for mounting said shaft for rotation about its axis; and an actuator operatively associated with said shaft at a portion thereof remote from said blade, for effecting rotation of said shaft about its axis, and coincident pivotal movement of said blade into contact with said anvil thread supporting surface.

4. A device as recited in claim 3 wherein said means for detachably mounting said blade comprises a threaded end of said shaft, and a pair of internally threaded nuts, one disposed on either side of said blade, abutting said blade, and in screwthreaded engagement with said shaft threaded end.

5. A device as recited in claim 1 wherein said means for effecting movement of said blade comprises: a shaft operatively attached to said blade and having an axis extending perpendicularly to and through said blade; a bushing for mounting said shaft for rotation about its axis; and an actuator operatively associated with said shaft at a portion thereof remote from said blade, for effecting rotation of said shaft about its axis, and coincident pivotal movement of said blade into contact with said anvil thread supporting surface.

6. A device as recited in claim 1 further comprising a fabric guide means attached to said anvil for preventing fabric from riding up on said thread supporting surface.

7. A shuttleless loom including means for inserting thread in an insertion cycle into the loom, and having a portion thereof, which includes a temple, adjacent the area of insertion of the thread, and including a thread severing mechanism for severing each inserted thread after completion of an insertion cycle;

said thread severing mechanism comprising an anvil having a thread supporting surface; a cutting blade having a razor edge; means for mounting said anvil on said temple; means for effecting movement of said blade with respect to said anvil thread supporting surface so that said blade razor edge comes in contact with said thread supporting surface, severing any thread supported thereon; and said means for mounting said anvil comprising: an elongated slot formed in a portion of said anvil extending in a dimension generally parallel to, or in-line with, said razor edge and generally perpendicular to said temple; a threaded fastener passing through said slot and being capable of being tightened in any relative position within said slot; and a threaded opening formed in said temple, said opening receiving said threaded fastener therein.

8. A shuttleless loom including means for inserting thread in an insertion cycle into the loom, and having a portion thereof, which includes a temple, adjacent the area of insertion of the thread, and including a thread severing mechanism for severing each inserted thread after completion of an insertion cycle;

said thread severing mechanism comprising an anvil having a thread supporting surface; a cutting blade having a razor edge; means for mounting said anvil on said temple; means for effecting movement of said blade with respect to said anvil thread supporting surface so that said blade razor edge comes in contact with said thread supporting surface, severing any thread supported thereon; and a fabric guide means, mounted on said anvil, for preventing loom fabric from riding up on said thread supporting surface, said fabric guide means comprising a rod extending outwardly from said anvil generally parallel to said temple.

9. A loom as recited in claim 7 wherein said means for effecting movement of said blade comprises: a shaft operatively attached to said blade and having an axis extending perpendicularly to and through said blade; a bushing for mounting said shaft for rotation about its axis; and an actuator operatively associated with said shaft at a portion thereof remote from said blade, for effecting rotation of said shaft about its axis, and coincident pivotal movement of said blade into contact with said anvil thread supporting surface.

10. A loom as recited in claim 7 wherein said anvil has a thread-supporting-surface-mounting portion thereof, which portion is generally perpendicular to said portion thereof containing said elongated slot.

11. A loom as recited in claims 7, 8 or 10 wherein said thread supporting surface comprises a block of material having the blade-protection and thread-severing-facilitating properties of rubber.

12. A loom as recited in claim 10 further comprising a fabric guide means extending outwardly from said anvil thread-supporting-surface-mounting portion for preventing loom fabric from riding up on said thread supporting surface.

13. A loom as recited in claims 12 or 6 wherein said fabric guide means comprises a rod extending outwardly from said anvil generally parallel to said temple.

* * * * *